US009687070B2

(12) United States Patent
Huang

(10) Patent No.: US 9,687,070 B2
(45) Date of Patent: Jun. 27, 2017

(54) TOOTHBRUSH HEAD

(71) Applicant: Acumen Co., Ltd., New Taipei (TW)

(72) Inventor: Shou-Jen Huang, New Taipei (TW)

(73) Assignee: Acumen Co., Ltd., New Taipei (TW)

( * ) Notice: Subject to any disclaimer, the term of this patent is extended or adjusted under 35 U.S.C. 154(b) by 0 days.

(21) Appl. No.: 14/746,917

(22) Filed: Jun. 23, 2015

(65) Prior Publication Data

US 2016/0374462 A1 Dec. 29, 2016

(51) Int. Cl.
*A46B 9/04* (2006.01)
*A46B 7/06* (2006.01)

(52) U.S. Cl.
CPC ..... *A46B 9/045* (2013.01); *A46B 9/04* (2013.01); *A46B 7/06* (2013.01); *A46B 2200/1066* (2013.01)

(58) Field of Classification Search
CPC ..... A46B 7/06; A46B 9/04
See application file for complete search history.

(56) References Cited

U.S. PATENT DOCUMENTS 52,833 A * 2/1866 Eagle ..... A46B 7/06 15/201
2,274,042 A * 2/1942 Cosby ..... A46B 9/04 15/167.1
2,796,620 A * 6/1957 Bressler ..... A46B 5/0025 15/201
2,882,544 A * 4/1959 Hadidian ..... A46B 5/0029 15/167.1
4,240,452 A * 12/1980 Jean ..... A46B 5/0029 15/167.1
5,158,342 A * 10/1992 Pai ..... A46B 1/00 264/243
5,184,368 A * 2/1993 Holland ..... A46B 7/06 132/308
5,350,219 A * 9/1994 Shou-Jen ..... A46B 3/08 264/243
5,524,319 A * 6/1996 Avidor ..... A46B 7/06 15/167.1
5,651,158 A * 7/1997 Halm ..... A46B 5/0025 15/167.1
5,839,149 A * 11/1998 Scheier et al. ..... A46B 5/0029 15/167.1
6,219,874 B1 * 4/2001 van Gelder et al. . A46B 5/0025 15/167.1
6,230,356 B1 * 5/2001 Hyo-Moon ..... A46B 5/0025 15/167.1

(Continued)

*Primary Examiner* — Michael Jennings
(74) *Attorney, Agent, or Firm* — Alan D. Kamrath; Kamrath IP Lawfirm, P.A.

(57) ABSTRACT

A toothbrush head includes a main body composed of multiple cylinder bodies, made of rigid material, and mounted by multiple bristles on the surface of each of the multiple cylinder bodies. The multiple cylinder bodies are separate or are connected to each other by connecting strips. A soft cladding layer is formed on an exterior of each of the multiple cylinder bodies. The toothbrush head can be connected to a brush holder to form a toothbrush. As each of the multiple cylinder bodies having multiple bristles can oscillate in different directions, the toothbrush can efficiently clean the teeth surface and crevices in different directions and facilitate convenience of cleaning.

4 Claims, 7 Drawing Sheets

(56) References Cited

U.S. PATENT DOCUMENTS 6,487,748 B1 * 12/2002 Dardar ..... A46B 7/04 15/167.1
6,505,373 B2 * 1/2003 van Gelder ..... A46B 5/0025 15/167.1
6,810,551 B1 * 11/2004 Weihrauch ..... A46B 3/04 15/167.1
8,281,448 B2 * 10/2012 Waguespack ..... A46B 5/0025 15/167.1
8,590,095 B2 * 11/2013 Crossman ..... A46B 7/06 15/167.1
8,745,804 B2 * 6/2014 Jaksha ..... A46B 9/04 15/143.1
8,806,695 B2 * 8/2014 Moskovich ..... A46B 9/04 15/167.1
8,876,221 B2 * 11/2014 Jimenez ..... A46B 5/002 15/110
9,254,033 B1 * 2/2016 Huang ..... A46B 9/04
2003/0066147 A1 * 4/2003 Roh ..... A46B 7/08 15/28
2008/0104785 A1 * 5/2008 Robinson ..... A46D 1/055 15/167.1
2009/0025165 A1 * 1/2009 Moskovich ..... A46B 5/0025 15/167.1
2010/0115724 A1 * 5/2010 Huang ..... A46B 9/025 15/167.1
2011/0047735 A1 * 3/2011 Jaksha ..... A46B 9/04 15/167.1
2011/0308026 A1 * 12/2011 Jimenez ..... A46B 5/002 15/106
2012/0204370 A1 * 8/2012 Crossman ..... A46B 7/06 15/167.1
2014/0245553 A1 * 9/2014 Gravina ..... A46B 9/04 15/167.1
2014/0359955 A1 * 12/2014 Huang ..... A46B 5/0037 15/167.1

* cited by examiner

TOOTHBRUSH HEAD

BACKGROUND OF THE INVENTION

1. Field of the Invention

The present invention relates to an oral cleaning tool and, especially, to a toothbrush head comprising bristles that can oscillate in different directions.

2. Description of the Prior Art

The conventional toothbrush comprises a toothbrush head and a brush holder connected to the toothbrush head. A thin rod is formed between the toothbrush and the brush holder for users to clean their teeth with the toothbrush head more conveniently. However, the toothbrush head of the conventional toothbrush is made of a rigid substrate, and bundles of the bristles are mounted into the surface of the rigid substrate in several rows at intervals. As a user brushes his teeth with the conventional toothbrush head, the conventional toothbrush head is put into the mouth, and the protruding part of the bristle bundles touch the teeth and the crevices between the teeth for cleaning.

However, the angle between the bristle bundles and the rigid substrate is approximately a right angle, such that each of the bristle bundles is unable to oscillate arbitrarily. Each of the bristle bundles of the conventional toothbrush can merely clean the teeth surface at a specific angle, and cannot clean the narrower crevices between the teeth or the outlying teeth. Therefore, a problem of insufficient cleaning effect on teeth is incurred.

SUMMARY OF THE INVENTION

To overcome the shortcomings, the present invention provides a toothbrush head to mitigate or obviate the aforementioned problems.

The main objective of the invention is to provide a toothbrush head that allows each of the bristle bundles mounted on the toothbrush head to oscillate individually in different directions to clean the teeth and improve the cleaning effect.

The toothbrush head in accordance with the present invention comprises a main body and a cladding layer. The main body is made of a rigid material, and the main body comprises multiple cylinder bodies. The cylinder bodies are arranged at intervals to form a shape of the toothbrush head. A socket is formed on each surface end of each of the multiple cylinder bodies. Each two of the cylinder bodies adjacent to each other are linked by a connecting strip. The cladding layer is made of a soft material, and the cladding layer wraps exteriors of each of the cylinder bodies and each of the multiple connecting strips.

Another toothbrush head in accordance with the present invention comprises a main body and a cladding layer. The main body is made of a rigid material, and the main body comprises multiple cylinder bodies. The cylinder bodies are arranged at intervals to form a shape of the toothbrush head. A socket is formed on each surface end of each of the multiple cylinder bodies. The cladding layer is made of a soft material, and the cladding layer wraps an exterior of each of the cylinder bodies.

A junction is formed at one end of the main body, and the junction is a block, has one of the multiple cylinder bodies formed thereon, and connects to several of the cylinder bodies.

A protruding rim is formed around the top external wall of each of the multiple cylinder bodies.

A brush holder is formed integrally connected to the main body, and the clapping layer wraps the junction of the main body and the brush holder.

For the reasons that the multiple cylinder bodies are linked to each other by the multiple connecting strips and enveloped by the clapping layer with soft material or each one of the multiple cylinder bodies is directly enveloped by the clapping layer with soft material, the bristles mounted on each of the multiple cylinder bodies can oscillate in different directions when touching the teeth, allowing the bristles to be bent to enter the crevices between the teeth more easily and enhance the cleaning effect. Besides, the toothbrush head of the present invention is easy to be use and is practical. Furthermore, the toothbrush head enveloped by the clapping layer with soft material protects the mouth from injury during brushing of the teeth.

DETAILED DESCRIPTION OF THE PREFERRED EMBODIMENTS

Figure 1:
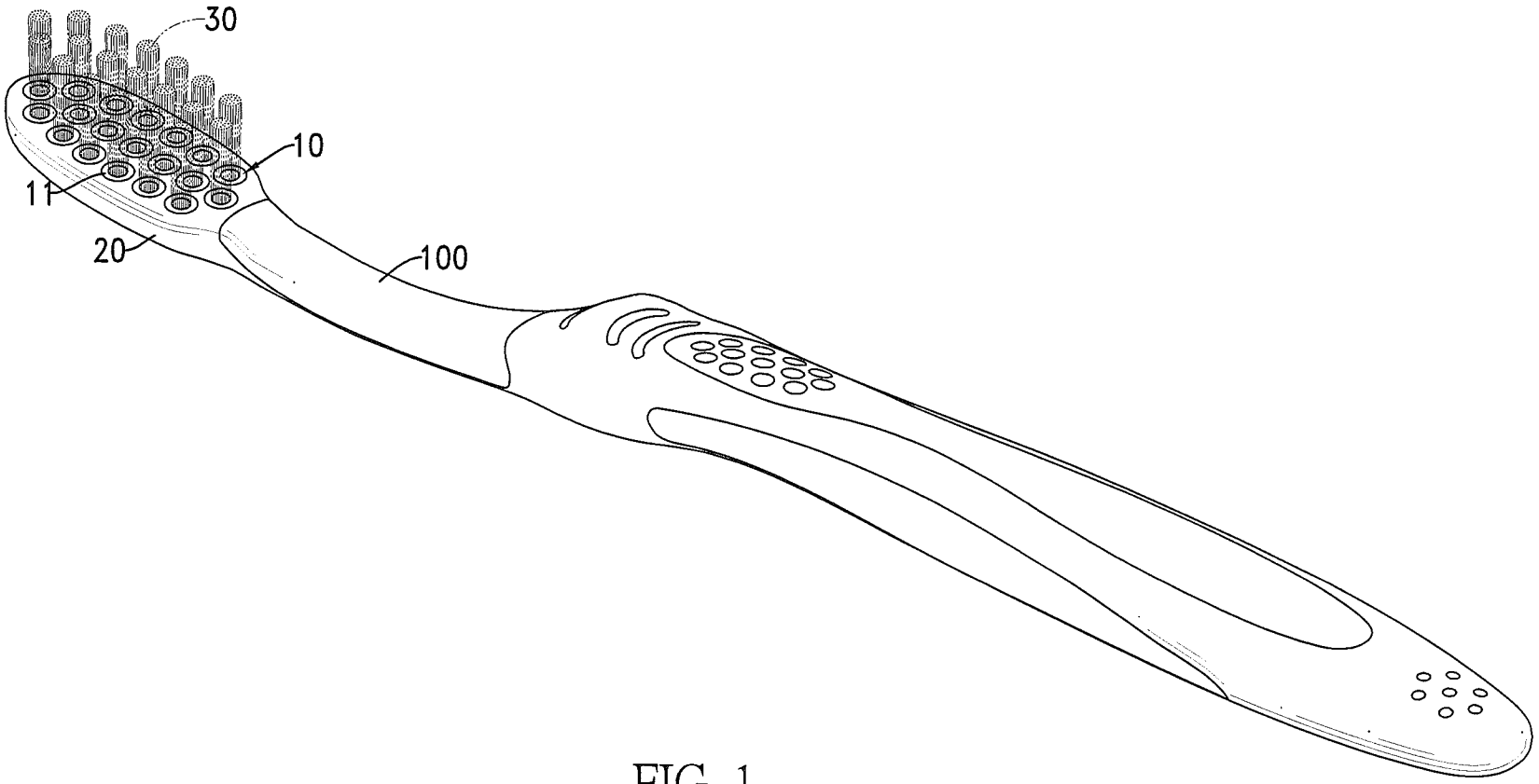
FIG. 1 is a perspective view of a toothbrush head in accordance with the present invention.
Figure 2:
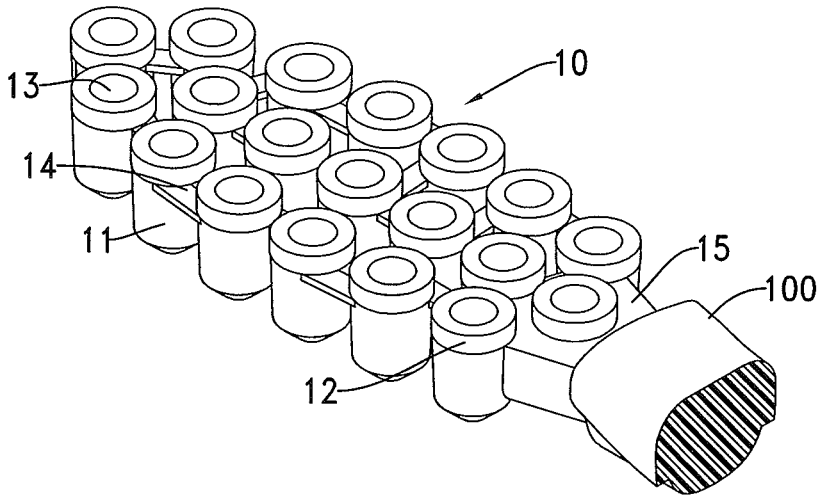
FIG. 2 is a perspective view of a main body of the toothbrush head in FIG. 1.

With references to FIG. 1 and FIG. 2, a toothbrush head in accordance with the present invention comprises a main body 10 and a cladding layer 20 formed outside of the main body 10. A brush holder 100 is formed integrally connected to the main body 10. The cladding layer 20 wraps the main body 10 and partially the brush holder 100. Multiple bundles of bristles 30 are mounted on the main body 10 to form the toothbrush with the brush holder 100 for users to hold the toothbrush.

Figure 4:
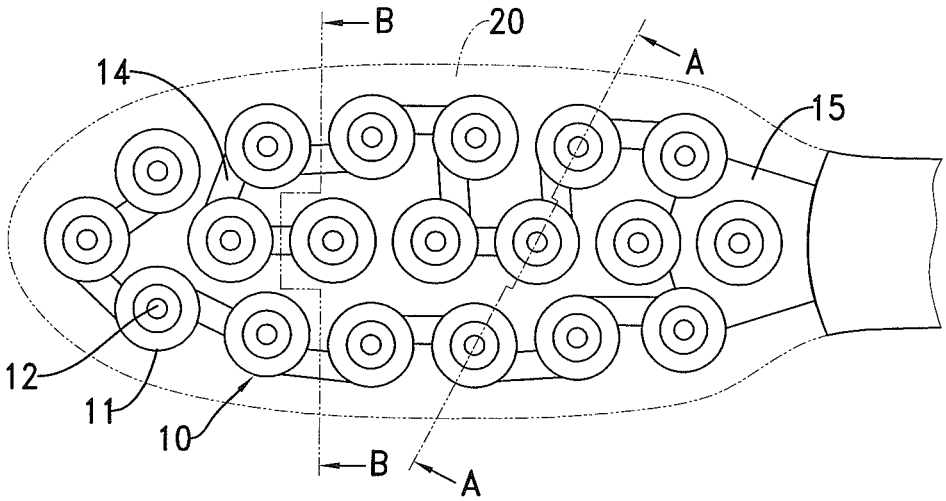
FIG. 4 is a plane view of the toothbrush head in FIG. 3.

One end of the main body 10 can be manufactured and formed integrally with one end of the brush holder 100 by the conventional techniques, such as plastic injection molding or other molding methods. The material of the main body 10 includes, but is not limited to rigid material, such as plastic material. The main body 10 comprises multiple cylinder bodies 11 which are upright. The multiple cylinder bodies 11 are arranged at intervals, and a protruding rim 12 is formed around a top external wall of each of the multiple cylinder bodies 11. A socket 13 is formed on a surface end of each of the multiple cylinder bodies 11 comprising the protruding rim 12, and a bundle of the bristles 30 is mounted into the socket 13. With reference to FIG. 4, multiple connecting strips 14 are each formed between the multiple cylinder bodies 11 adjacent to each other. Each of the multiple connecting strips 14 is a thin strip and allows each of the multiple cylinder bodies 11 to be arranged at a specific position to form a shape of the toothbrush head. Each of the multiple connecting strips 14 connecting the multiple cylinder bodies 11 allows each of the multiple cylinder bodies 11 to oscillate arbitrarily. Each of the multiple connecting strips 14 can be formed by a flow channel of the forming mold material of the multiple cylinder bodies 11.

With references to FIGS. 2 and 4, a junction 15 can be formed on one end of the main body 10 during the injection molding. The junction 15 is a block and connects with the multiple cylinder bodies 11. The junction 15 of the main body 10 can be formed integrally with the brush holder 100 and linked to the brush holder 100 during the injection molding.

Figure 3:
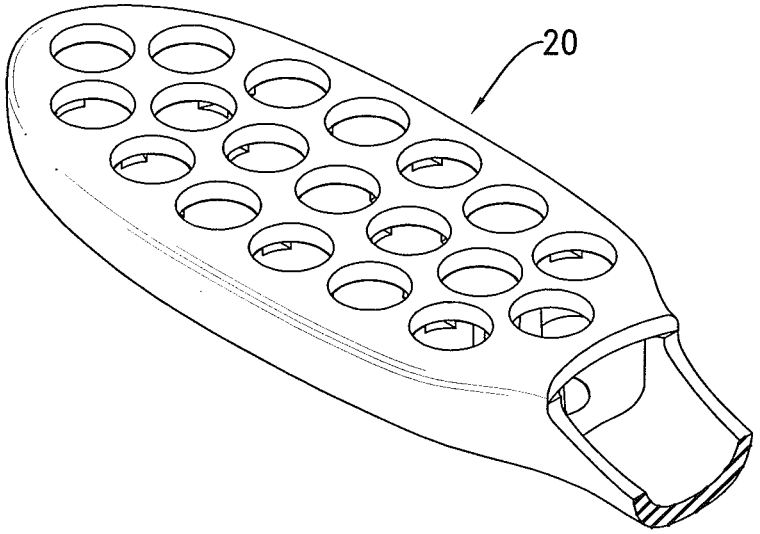
FIG. 3 is a perspective view of a cladding frame formed wrapping an exterior of the main body in FIG. 2.
Figure 5:
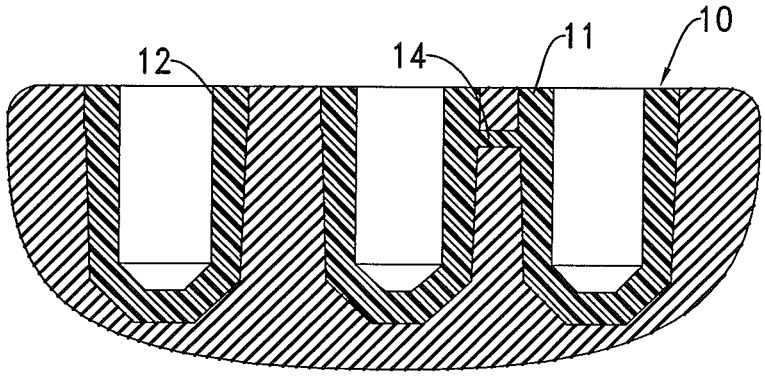
FIG. 5 is a side-sectional view of the toothbrush head across line A-A in FIG. 4.
Figure 6:
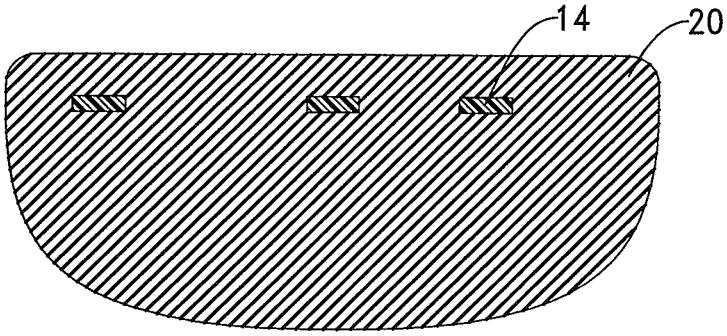
FIG. 6 is a side-sectional view of the toothbrush head across line B-B in FIG. 4.

With references to FIGS. 1 to 3, the cladding layer 20 wraps the main body 10 and the brush holder 100 adjacent to the main body 10 by the conventional techniques, such as secondary injection molding or other techniques. The material of the cladding layer 20 is a soft material, such as silicon rubber. The cladding layer 20 envelops each of the multiple cylinder bodies 11 and the protruding rim 12 of the main body 10. Besides, a top of the cladding layer 20 is level with a top of each of the multiple cylinder bodies 11. With reference to FIGS. 5 and 6, the cladding layer 20 envelops each of the multiple cylinder bodies 11 and the protruding rim 12 of the main body 10 as well as each of the multiple connecting strips 14 for fixed connection between the main body 10 and the cladding layer 20.

With reference to FIG. 1, each of the multiple cylinder bodies 11 mounted with the bristles 30 is connected by each of the multiple connecting strips 14 and enveloped by the cladding layer 20 with soft material. Therefore, each of the multiple cylinder bodies 11 mounted with the bristles 30 can oscillate individually in different directions. Each of the bundles of the bristles 30 can oscillate individually in different directions, and clean the teeth surface and residues in the crevices between the teeth, improving the cleaning effect of teeth.

Figure 7:
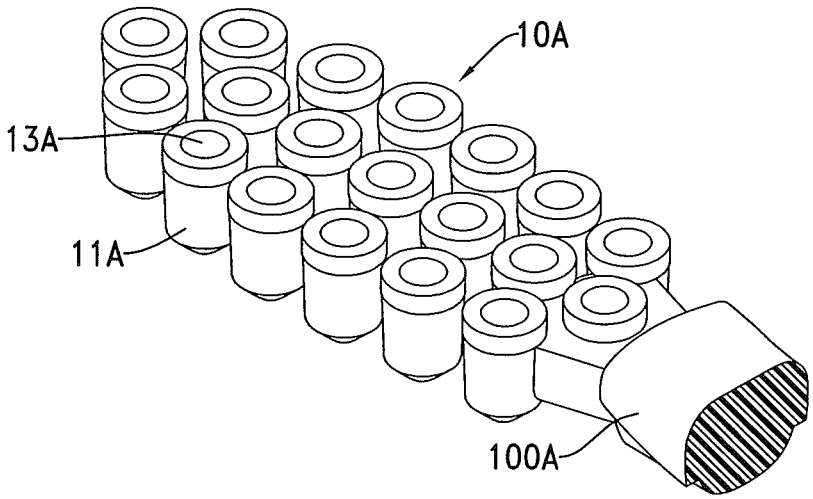
FIG. 7 is a perspective view of a main body of another embodiment in accordance with the present invention.
Figure 8:
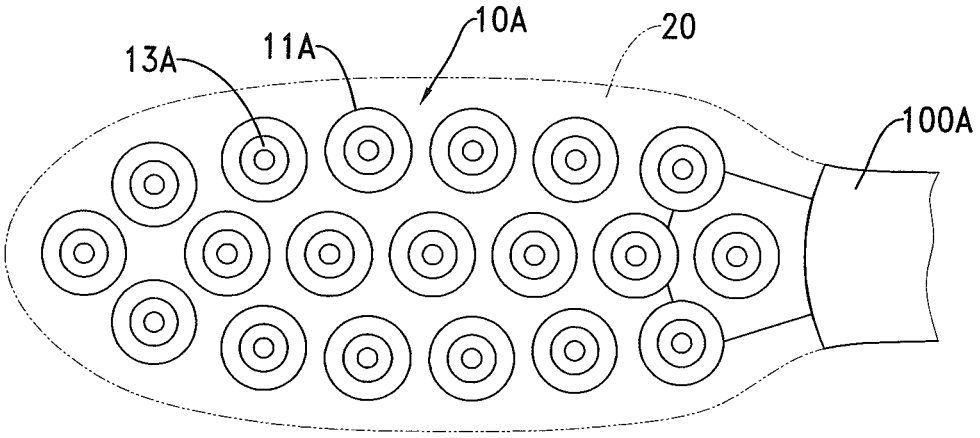
FIG. 8 is a plane view of the main body in FIG. 7.
Figure 9:
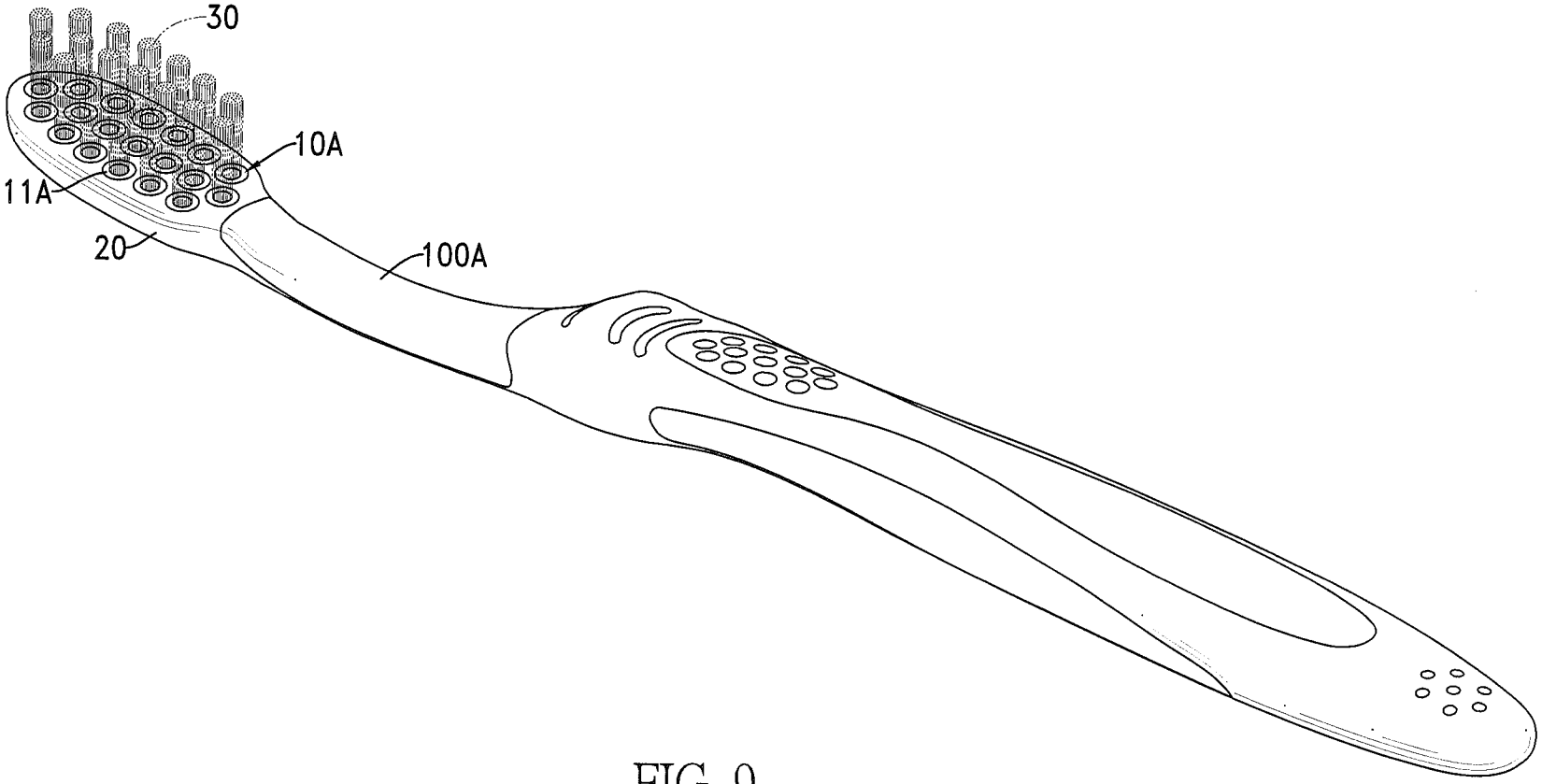
FIG. 9 is a perspective view of the toothbrush head of said another embodiment in accordance with the present invention.

With references to FIGS. 7, 8 and 9, for another embodiment of the present invention, the multiple cylinder bodies 11A forming the main body 10A are separated without being connected with each other. Each one of the multiple cylinder bodies 11A and the socket 13A formed on the top surface of each of the multiple cylinder bodies 11A are formed by the conventional plastic overmolding technique. Each of the multiple cylinder bodies 11A and the brush holder 100A can be put in a forming mold followed by injection forming the cladding layer 20 wrapped on exteriors of the main body 10A and the brush holder 100A, and the toothbrush is manufactured. Each of the multiple cylinder bodies 11A is enveloped and fixed by the cladding layer 20 with soft material, and the bristles 30 are mounted into the socket 13A of each of the multiple cylinder bodies 11A. Each of the multiple cylinder bodies 11A can oscillate individually in a different direction to efficiently clean the teeth from all directions.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A toothbrush head comprising:

a main body made of rigid material and comprising:

multiple cylinder bodies, wherein each of the multiple cylinder bodies comprises:

a top end, a bottom end, and a cylindrical surface extending between the top and bottom ends;

a socket formed on the top end of the cylinder body; and multiple connecting strips, wherein the multiple connecting strips are formed between the cylindrical surfaces of two adjacent cylinder bodies, with the multiple connecting strips being spaced from the top and bottom ends; and a cladding layer made of soft material and enveloping the bottom ends and the cylindrical surfaces of all of the multiple cylinder bodies and all of the multiple connecting strips.

2. The toothbrush head as claimed in claim 1, wherein one end of the main body forms a junction, wherein the junction is a block, has a cylinder body formed thereon, and connects with several of the multiple cylinder bodies.

3. The toothbrush head as claimed in claim 2, wherein a protruding rim is formed around a top external wall of the top end of each of the multiple cylinder bodies.

4. The toothbrush head as claimed in claim 2, wherein the junction of the main body further extends and forms a brush holder, and wherein the clapping layer envelops the junction of the main body and the brush holder.

* * * * *